US005876145A

United States Patent [19]

Datum

[11] Patent Number: 5,876,145

[45] Date of Patent: Mar. 2, 1999

[54] MULTIPLE SHEETS GROUPING DEVICE FOR LOOSE LEAF FILES

[76] Inventor: Robert J. Datum, 12 Chadwick Pl., Niantic, Conn. 06357

[21] Appl. No.: 840,310

[22] Filed: Apr. 11, 1997

[51] Int. Cl.[6] ..... B42F 21/06

[52] U.S. Cl. ..... 402/4; 281/42; 281/45; 283/37; 283/39; 283/41; 402/79

[58] Field of Search ..... 281/42, 45; 283/37, 283/39, 41; 402/4, 79

[56] References Cited

U.S. PATENT DOCUMENTS

| | | | |
|---|---|---|---|
| 866,167 | 9/1907 | Tiffany . | |
| 1,488,616 | 4/1924 | Robbins . | |
| 3,043,737 | 7/1962 | Engelstein . | |
| 3,353,844 | 11/1967 | Staats . | |
| 4,784,508 | 11/1988 | Shannon . | |
| 4,824,273 | 4/1989 | Silva et al. . | |
| 4,925,720 | 5/1990 | Hansen | 402/79 |
| 5,044,807 | 9/1991 | Meservy et al. . | |
| 5,590,972 | 1/1997 | Shobin | 402/79 |

*Primary Examiner*—Willmon Fridie, Jr.
*Assistant Examiner*—Mark T. Henderson
*Attorney, Agent, or Firm*—Albert W. Hilburger

[57] ABSTRACT

A stationery appliance for use with a loose leaf ring binder that has at least two closure rings capable of holding punched sheets in an organized manner. The appliance comprises a grouping device selectively encircling a plurality of the sheets to define an integral group thereof and maintain the integral group segregated from all of the other sheets held by the closure rings of the ring binder. The grouping device is selectively releasable to permit inspection of individual sheets of the integral group or removal of individual sheets from the ring binder. In one embodiment, the grouping device includes an elongated strip of flexible sheet material extending between first and second ends, the strip including a bight portion intermediate the first and second ends to define an upper elongated flap generally contiguous with an uppermost sheet of the integral group of sheets and a lower elongated flap generally contiguous with a lowermost sheet of the integral group of sheets. Attachment holes are provided adjacent the first and second ends for being freely received on the closure rings of the ring binder, the first end being removable from the closure ring to allow the upper elongated flap to be lifted away from engagement with the uppermost sheet of the integral group thereof to thereby yield free access to the individual sheets of the integral group.

15 Claims, 4 Drawing Sheets

MULTIPLE SHEETS GROUPING DEVICE FOR LOOSE LEAF FILES

BACKGROUND OF THE INVENTION

1. Field of the Invention

The present invention relates generally to notebook accessories and, more particularly, to an accessory for grouping loose-leaf data sheets in a manner enabling a user to rapidly access them with minimal effort.

2. Description of the Prior Art

Over the years, a variety of arrangements have been proposed for maintaining, in an organized but separated fashion, diverse forms of information. These arrangements have often used loose leaf notebooks as the main holding device and included, within each notebook, separators of various configurations and colors, tabs of various shapes and sizes, sheet-type carriers, and numerous other aids. At the same time, numerous recommendations have been suggested to improve the usability, in general, of the conventional loose leaf notebook. Many of these improvements have been presented in the patent literature. Some typical examples follow.

For instance, U.S. Pat. No. 5,044,807 issued on Sep. 3, 1991 to Meservy et al. discloses a writing platform for a loose leaf notebook which includes a writing table that can be elevated from a flat configuration to an elevated position along one edge so as to provide a writing surface beneath one or more pages in the notebook.

In U.S. Pat. No. 4,824,273 issued on Apr. 25, 1989 to Silva et al. an insert is disclosed which is adapted to be retained in a loose leaf notebook for effective display of information. Each insert includes first and second sections joined along a common edge and movable from a folded condition essentially protecting the stored contents to an extended position which exposes information in certain display areas and allows removal of bulk stored information.

U.S. Pat. No. 4,784,508 issued Nov. 15, 1988 to Shannon discloses a tabular indexing system for use in loose leaf binders having index insert sheets incorporating perforations defining a plurality of index tabs so that unused tabs may be removed from the insert sheets, and protective transparent carriers into which the index sheets are inserted.

In U.S. Pat. No. 3,353,844 issued Nov. 21, 1967 to Staats, there is disclosed a replacement for a loose leaf notebook comprising a backbone for multiple leaves of the notebook such that the leaves may be readily inserted and removed one at a time without disturbing the other leaves of the notebook.

U.S. Pat. No. 3,043,737 issued Jul. 18, 1962 to Engelstein discloses a transparent sheet protector constituted by separate panels of plastic material in superposed relation which are interconnected by parallel ribs of strip material to define an inner jacket for insertion of a sheet to be displayed and an outer pocket for insertion of an index card.

These types of concerns were addressed much earlier in the century as well. For example, U.S. Pat. No. 1,488,616 which issued on Apr. 1, 1924 to Robbins discloses a folio for sheet music into which individual sheets may be kept separate, retained in a desired order and arrangement and readily located and inserted and removed at will.

Finally, U.S. Pat. No. 866,167 issued Sep. 1, 1907 to Tiffany discloses a card index system or ledger by which the account of any individual can be readily determined as well as the items forming the accountant whereby the merchant's monthly summary of outstanding accounts can be readily determined.

It was with knowledge of the foregoing disclosures representative of the state of the art that the present invention was conceived and has now been reduced to practice.

The present invention relates to a stationery appliance for use with a loose leaf ring binder has at least two closure rings capable of holding punched sheets in an organized manner and comprises a grouping device selectively encircling a plurality of the sheets to define an integral group thereof and maintain the integral group segregated from all of the other sheets held by the closure rings of the ring binder. The grouping device is selectively releasable to permit inspection of individual sheets of the integral group or removal of individual sheets from the ring binder. In one embodiment, the grouping device includes an elongated strip of flexible sheet material extending between first and second ends, the strip including a bight portion intermediate the first and second ends to define an upper elongated flap generally contiguous with an uppermost sheet of the integral group of sheets and a lower elongated flap generally contiguous with a lowermost sheet of the integral group of sheets. Attachment holes are provided adjacent the first and second ends for being freely received on the closure rings of the ring binder, the first end being removable from the closure ring to allow the upper elongated flap to be lifted away from engagement with the uppermost sheet of the integral group thereof to thereby yield free access to the individual sheets of the integral group.

In another manner of speaking, the invention relates to a system of devices which enables capture of ring notebook documents into groups of data yet enables active use of the documents for review, revision and copying. A strip of thin sheet material such as paper, card stock, Tyvek®, Mylar®, or other generally equivalent plastic, is stiffened by material added on at least one end. A hole or holes which may be approximately at least twice but normally three times the diameter of the ring on which it is to be used is located to allow alignment with a hole or holes in sheets containing the documents. A cut or slice in the sheet material depending on the characteristics of the material enables disassembly, that is, removal of the sheet material without the necessity of opening the ring or rings on the ring binder. This item is attached at assembly or in manufacture to a document backing piece which may or may not be of identical shape and may even be part of the aforementioned hook strip which completes the capture of documents. Some of these devices may require scissors or some other cutting device for initial installation trimming. However, no tools or special skills are required to detach or add individual sheets to the captured group. Documents using these devices are not subject to damage by puncture or mutilation when reviewing, or when adding to the captured document package, or when removing pages. These strips may be provided in varying colors to enhance the classification procedure.

Accordingly, a primary object of the present invention is to provide an improved stationery appliance.

Another object of the present invention is to provide an accessory for a loose leaf notebook which collects loose-leaf data sheets into groups for quick reference.

A further object of the invention is to provide an accessory which allows the review of groups of data sheets without removing or undoing the rings of a loose-leaf binder.

Still another object of the present invention is to provide an accessory for a loose leaf notebook which helps protect the punched holes of data sheets from damage and which eliminates the inadvertent loss of data sheets.

Yet another object of the present invention is to provide an accessory for a loose leaf notebook which eliminates the need of stapling loose-leaf files resulting in damage to the pages thereof.

Still a further object of the present invention is to provide an accessory for a loose leaf notebook which reduces copier jams and subsequent equipment damage.

Another object of the present invention is to provide an accessory for a loose leaf notebook in the form of a grouping device which is used to selectively encircle a plurality of sheets to define an integral group thereof and maintain the integral group segregated from all of the other sheets held by closure rings of the ring binder, the grouping device being selectively releasable to permit inspection of individual sheets of the integral group or removal of individual sheets from the ring binder, as desired.

A further object of the present invention is to provide such an accessory which is relatively inexpensive to manufacture, can be easily used and is adaptable to loose leaf notebooks which are currently in use. Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
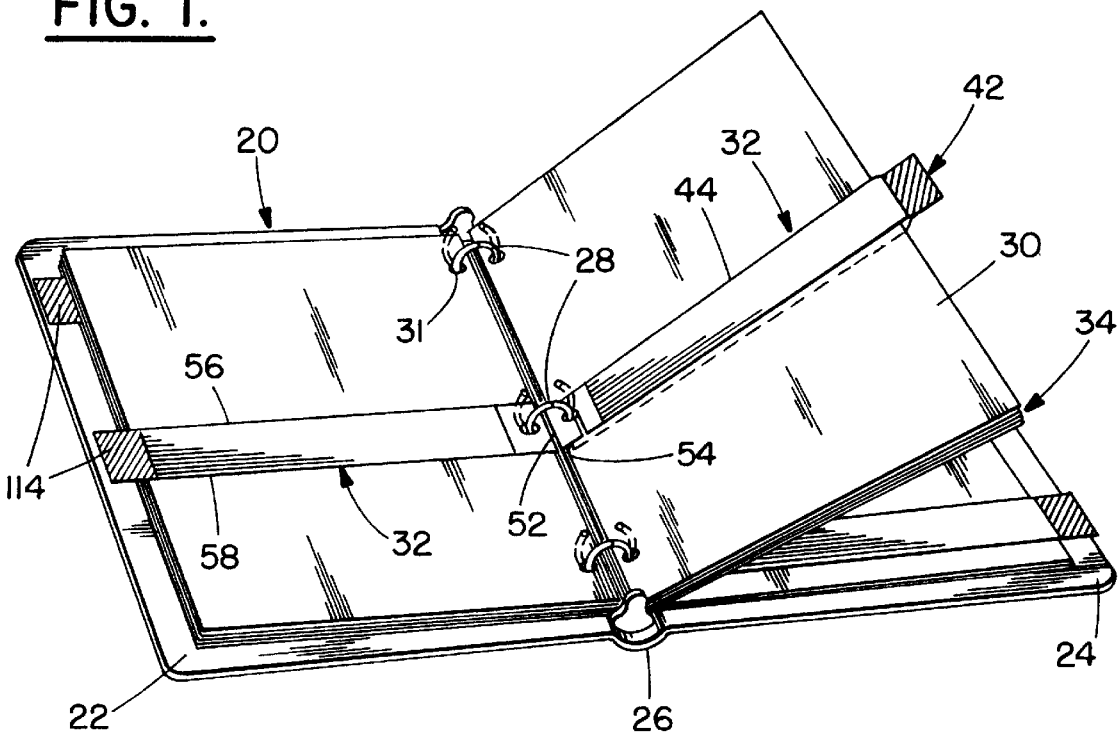
FIGS. 1 and 2 are perspective views of a loose leaf notebook or ring binder containing a plurality of data sheets and utilizing the grouping device of the invention.
Figure 2:
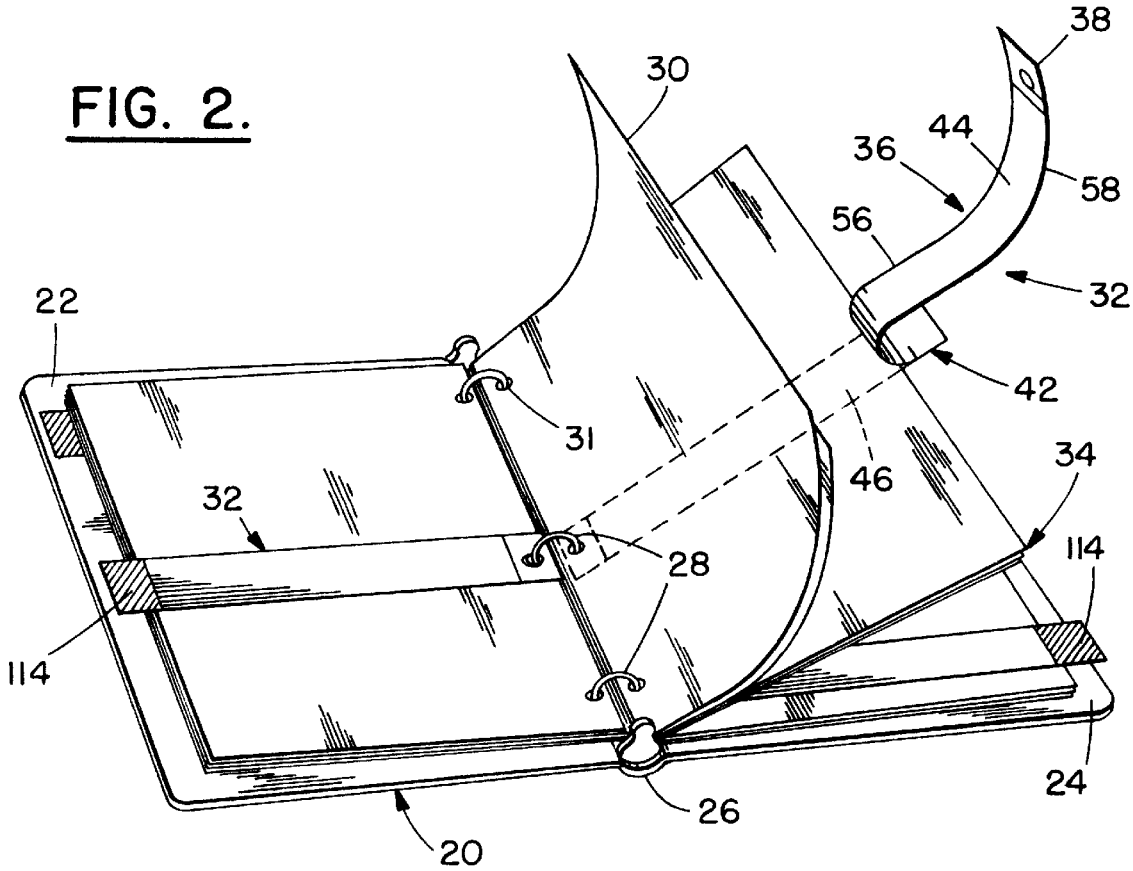

Turn now to the drawings and, initially, to FIGS. 1 and 2 which generally illustrate a loose leaf notebook 20 of conventional design including front and rear covers 22, 24, respectively, a spine 26 connecting the front and rear covers, and a plurality of closure rings 28 at spaced locations along the spine. The closure rings 28 of the loose leaf notebook are selectively movable between the closed, solid line positions illustrated in FIG. 1 to fully capture thereon sheets 30 with spaced attachment holes 31 and the dashed line positions (FIG. 1) to enable removal of the sheets from the loose leaf notebook.

Also illustrated in FIGS. 1 and 2 is a grouping device 32, generally embodying the invention, selectively encircling a plurality of the sheets 30 to define an integral group 34 thereof and maintain the integral group segregated from all of the other sheets held by the closure rings of the ring binder. In a manner to be described, the grouping device 32 is selectively releasable from the closure ring 28, as indicated by dashed lines, to permit inspection of individual sheets 30 of the integral group 34 or removal of individual sheets from the ring binder.

Figure 3:
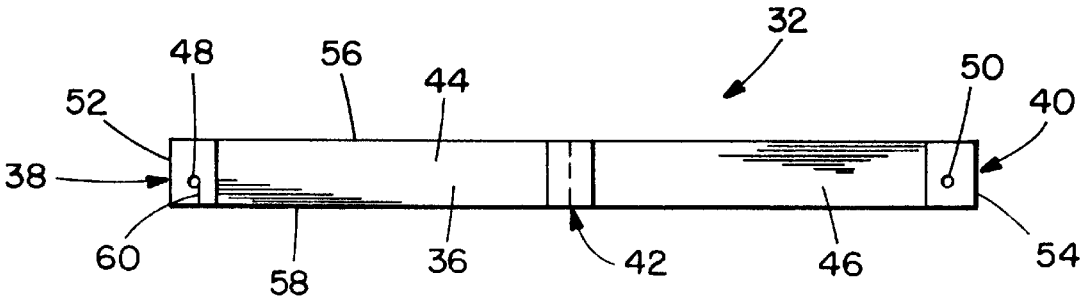
FIG. 3 is a detail plan view of one embodiment of the grouping device of the invention.
Figure 4A:
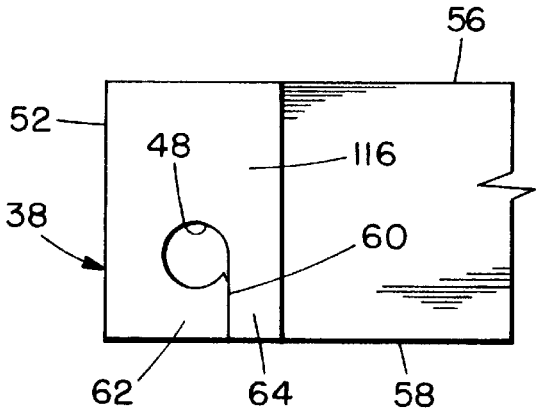
FIGS. 4A and 4B are detail plan views of two different embodiments of the invention.
Figure 4B:
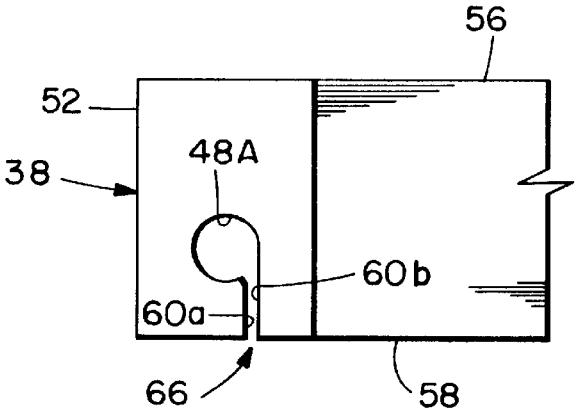
Figure 4:
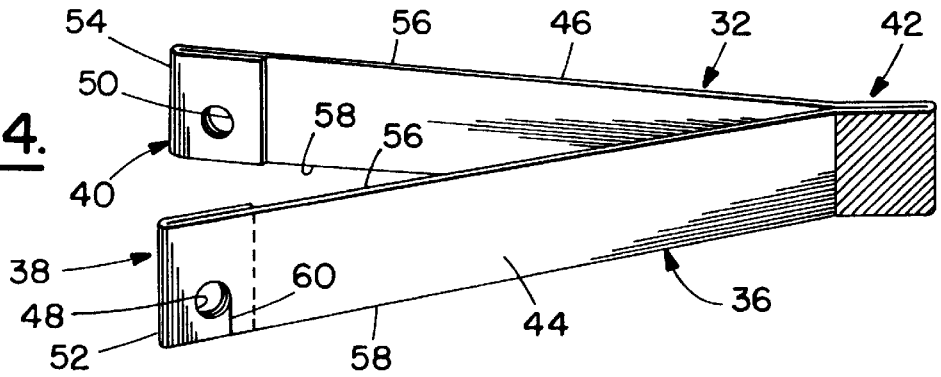
FIG. 4 is a perspective view of the grouping device of the invention.
Figure 5:
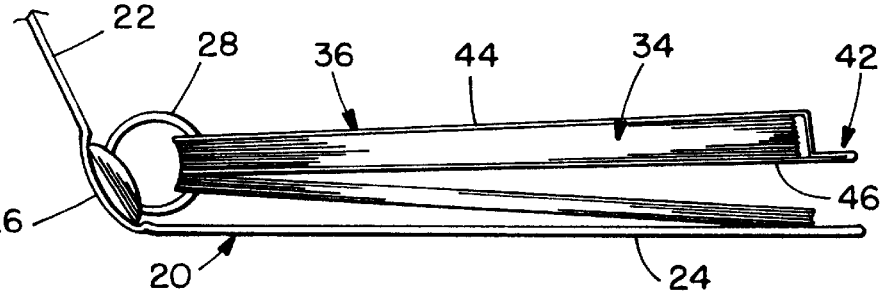
FIG. 5 is an end view of the loose leaf notebook or ring binder containing a plurality of data sheets and utilizing the grouping device of the invention.

Turning now to FIG. 3, the grouping device 32 includes an elongated strip 36 of flexible sheet material extending between first and second ends 38, 40, respectively. As illustrated in FIG. 3, the elongated strip 36 is stretched out in a planar pre-use orientation and as illustrated in FIG. 4 is in its as-used orientation. The elongated strip 36 includes a bight portion 42 intermediate the first and second ends 38, 40 to define (viewing FIG. 5) an upper elongated flap 44 generally contiguous with an uppermost one of the sheets 30 of the integral group of sheets 34 and a lower elongated flap 46 generally contiguous with a lowermost sheet of the integral group of sheets. The elongated strip 36 has attachment holes 48, 50 adjacent the first and second ends 38, 40, respectively, for being freely received on the closure rings 28 of the loose leaf ring binder 20. With this construction, viewing FIG. 2, the first end 38 is removable from the closure ring 28 allowing the upper elongated flap 44 to be lifted away from engagement with the uppermost sheet 30 of the integral group 34 to thereby yield free access to the individual sheets of the integral group.

Continuing with the description of the grouping device 32, with reference to FIGS. 1, 2, and 3, each of the elongated flaps 44, 46 has first and second spaced apart generally parallel longitudinal edges 52, 54, respectively, and first and second spaced apart generally parallel transverse edges 56, 58, respectively, extending between the longitudinal edges 52, 54. In one instance, as illustrated in FIG. 4, the attachment hole 50 may be isolated from its associated edges 54, 56, and 58. In another instance, as illustrated in FIGS. 4 and 4A, at least the upper elongated flap 44 has a cut line 60 extending between the attachment hole 48 at the first end 38 and the transverse edge 58 thereby separating opposed lands 62, 64, respectively, resulting in an opening between the lands enabling relative flexure of the opposed lands to enlarge the opening created by the cut line 60 for selective removal of the first end from the closure ring 28 of the ring binder and attachment to the closure ring. In still another embodiment illustrated in FIG. 4B, the cut line 60 may be broadened to create a strait 66 with opposed cuts 60*a* and 60*b*. In this instance, the width of the strait 66 may be substantially smaller than the major breadth of the cross section of the closure ring 28 and, preferably one third, or less, than the diameter of the modified attachment hole 48*a*.

Figure 6:
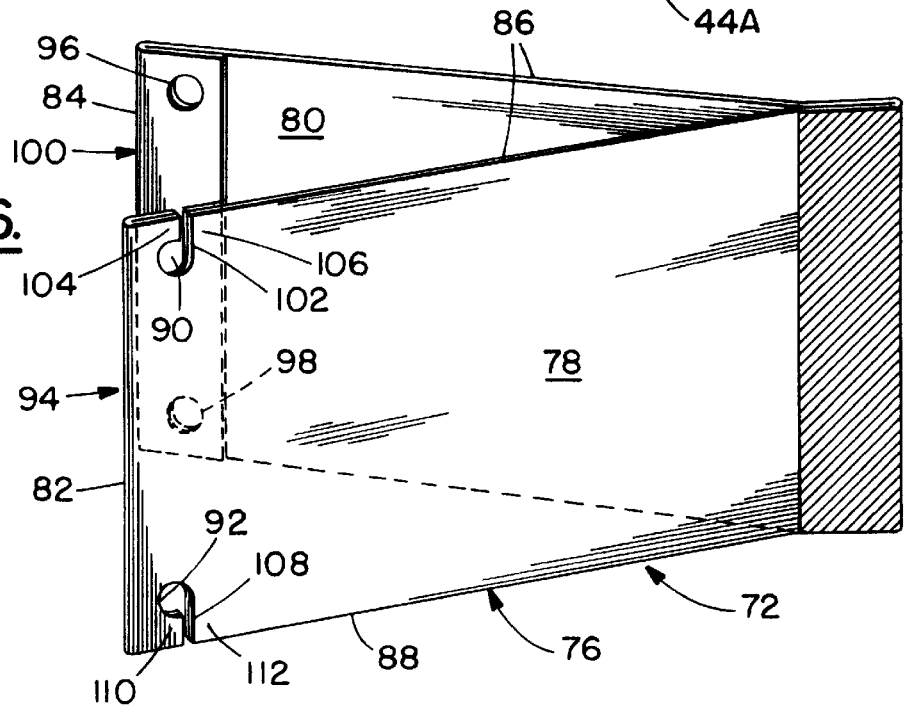
FIG. 6 is a perspective view of another embodiment of the invention.

In yet another embodiment illustrated in FIG. 6, a modified grouping device 72 includes an elongated strip 76 with upper and lower elongated flaps 78, 80 with first and second spaced apart generally parallel longitudinal edges 82, 84, respectively, and first and second spaced apart generally parallel transverse edges 86, 88, extending between the longitudinal edges. The upper elongated flap 78 has first and second spaced apart attachment holes 90, 92, respectively, adjacent a first end 94 for free reception thereof on associated, or the adjacent, spaced apart closure rings 28 of the loose leaf ring binder. In a similar fashion, the lower elongated flap 80 has first and second spaced apart attachment holes 96, 98 adjacent a second end 100 for free reception thereof on the same closure rings 28 as occupied by the end 94 of the upper elongated flap 78. At least the upper elongated flap 78 has a first cut line 102 extending between the first attachment hole 90 at the first end 94 and the first transverse edge 86 separating opposed lands 104, 106 and, in a similar fashion, a second cut line 108 extending between the second attachment hole 92 and the second transverse edge 88 separating opposed lands 110, 112. As in the instance of the grouping device 32, relative flexure of the opposed lands 104, 106 adjacent the transverse edge 86 and of the opposed lands 110, 112 adjacent the transverse edge 88 causes enlargement, respectively, of the openings created by the cut lines 102, 108 for selective removal of the first end 94 from the closure rings of the ring binder.

For any of the embodiments described, the grouping devices of the invention, viewing FIGS. 1 and 2, preferably include an index tab 114 integral with, for example, the bight portion 42 of the grouping device 32, and extending away therefrom in a direction away from the first end 38. In a normal fashion, the purpose of the index tab is to provide indicia defining and describing the information contained within the integral group 34.

Figure 7B:
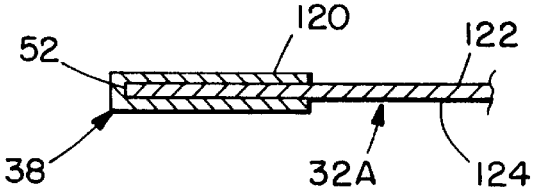
FIGS. 7A, 7B, 7C, and 7D are detail cross section views illustrating other embodiments of the invention.

Again, for any of the embodiments disclosed herein, it would be desirable for the grouping device 32 to be provided with a reinforcement strip 116 extending along each of the ends 38, 40, for example. See FIGS. 4A and 7A. The reinforcement strip 116 encompasses the attachment holes 48, 50 and is bonded to the ends 38, 40. Another modified grouping device 32A, for example, utilizes a reinforcement strip 120 as illustrated in FIG. 7B. In this instance, the reinforcement strip 120 extends along each of the ends 38, 40, is folded along the longitudinal edge 52 which is bonded to, and overlies upper and lower surfaces 122, 124, respectively, and encompasses the attachment holes 48 and 50. In the alternative, a plastic coating may be bonded to the upper and lower surfaces 122, 124 of the grouping device 32A adjacent the longitudinal edges 52, 54 to provide reinforcement similar to that provided by the reinforcement strip 120. Indeed, the plastic coating would be equivalent to the reinforcement strip.

Figure 7C:
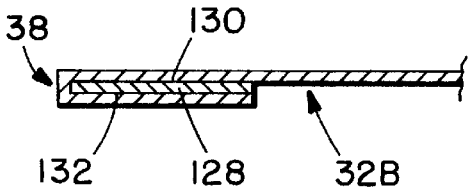

Another modified grouping device 32B, for example, utilizes a reinforcement band 128 as illustrated in FIG. 7C. In this instance, the elongated reinforcement band 128 having opposed surfaces 130, 132 extends along each of the ends 38, 40 and is coextensive with the attachment holes 48, 50. The ends 38, 40, respectively, of the grouping device 32B are each folded to overlie the opposed surfaces 130, 132 of an associated reinforcement band 128 and are suitably bonded to the reinforcement band.

Figure 7D:
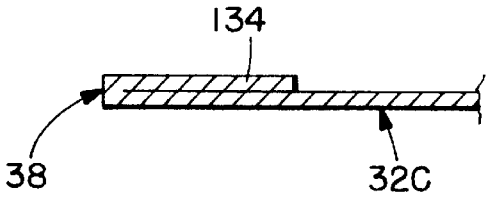
Figure 7A:
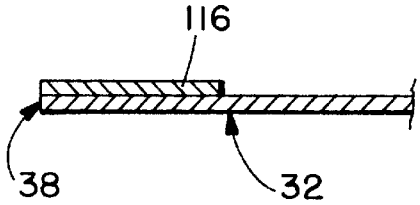

In yet another instance, viewing FIG. 7D, an elongated end portion 134 may be folded onto itself and suitably bonded. This construction is also illustrated in FIGS. 4 and 6.

Figure 8:
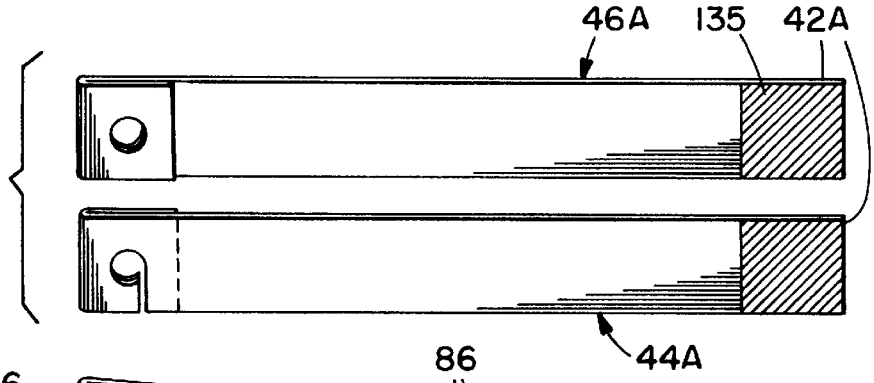
FIG. 8 is a perspective view illustrating still another embodiment of the invention.

It may also be desirable to construct an elongated strip 32 out of a pair of individual elongated strips 44A, 46A as illustrated in FIG. 8. In this instance, the individual elongated strips 44A, 46A are positioned in face to face relationship. Pressure sensitive adhesive 135 is provided on the facing surfaces in the region of the bight portion 42A for each, then the facing surfaces of the bight portions are pressed together resulting in a united elongated strip generally of the nature of the grouping device 32 described above.

Figure 9:
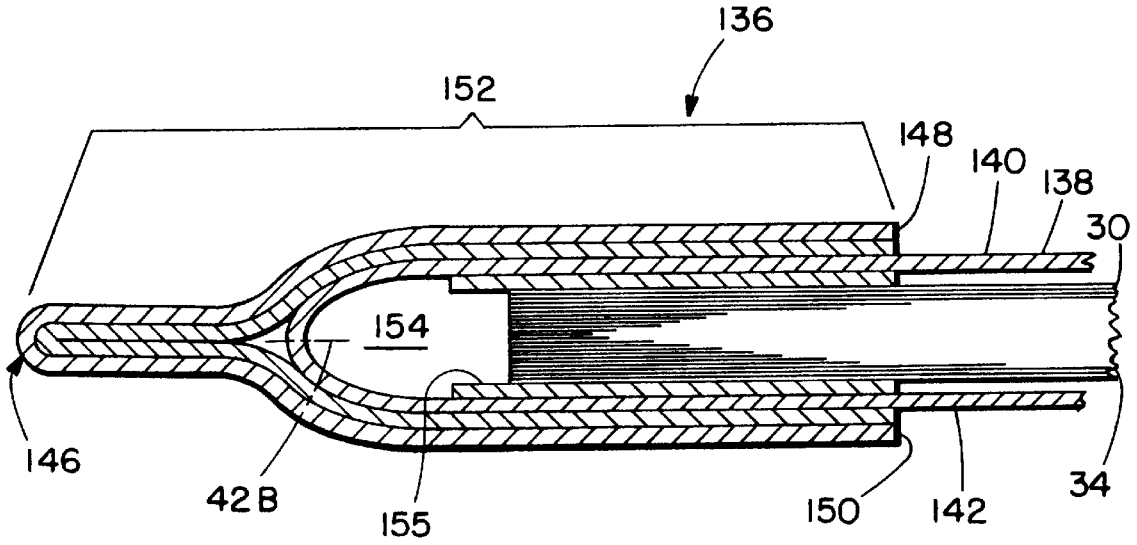
FIG. 9 is a detail cross section view illustrating yet another embodiment of the invention.

Still another embodiment of the invention is illustrated in FIG. 9. In this instance, a gripper device 136 is provided at a modified bight portion 42B enabling an elongated strip 138 having upper and lower elongated flaps 140, 142, respectively, to embracingly receive and firmly hold a plurality of edges of the integral group of sheets 34. To this end, a semi-rigid band 144 of sheet material is folded along a central edge so as to overlie outer facing surfaces of the upper and lower elongated flaps at the bight portion and extend to an upper terminal transverse edge 148 and to a lower terminal transverse edge 150 spaced proximately from said bight portion and distantly from said longitudinal edges of said upper and lower elongated flaps, respectively. Inner surfaces of the upper and lower elongated flaps 140, 142 of the gripper device 136 are bonded together from bight portion 42B at a region 152 extending generally from the central edge 146 to locations intermediate the central edge and the upper and lower terminal transverse edges 148, 150 to thereby define a pocket 154 extending generally intermediate the bond region 152 and a line generally coterminous with the upper and lower terminal transverse edges. The resulting construction enables the embracing reception thereat of a plurality of edges of the integral group of sheets 34 by the inner surfaces of the upper and lower elongated flaps 140, 142, preferably provided in a suitable manner with an adherent grip coating 155.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A stationery appliance for use with a loose leaf ring binder having at least two closure rings capable of holding punched sheets in an organized manner, said stationery appliance comprising:

grouping means encircling a plurality of the sheets to define an integral group thereof and maintain the integral group segregated from all of the other sheets held by the closure rings of the ring binder, said grouping means being selectively releasable to permit inspection of individual sheets of the integral group or removal of individual sheets from the ring binder, said grouping means including:

an elongated strip of flexible sheet material extending between first and second ends, said strip including a bight portion intermediate said first and second ends to define an upper elongated flap generally contiguous with an uppermost sheet of the integral group of sheets and a lower elongated flap generally contiguous with a lowermost sheet of the integral group of sheets, and having attachment holes adjacent said first and second ends for being freely received on the closure rings of the ring binder, said first end being removable from the closure ring allowing said upper elongated flap to be lifted away from engagement with the uppermost sheet of the integral group thereof to thereby yield free access to the individual sheets of the integral group thereof.

2. A stationery appliance as set forth in claim 1 wherein each of said elongated flaps has first and second spaced apart generally parallel longitudinal edges and first and second spaced apart generally parallel transverse edges extending between said longitudinal edges; and wherein at least said upper elongated flap has a cut line extending between the hole at said first end and said first transverse edge thereby separating opposed lands thereof and resulting in an opening therebetween enabling relative flexure of said opposed lands to enlarge the opening created by the cut line for selective removal of said first end from the closure ring of the ring binder and attachment thereto.

3. A stationery appliance as set forth in claim 1 wherein each of said elongated flaps has first and second spaced apart generally parallel longitudinal edges and first and second spaced apart generally parallel transverse edges extending between said longitudinal edges; and wherein said upper elongated flap has first and second spaced apart attachment holes adjacent said first end for free reception thereof on first and second associated spaced apart closure rings of the loose leaf ring binder;

wherein said lower elongated flap has first and second spaced apart attachment holes adjacent said second end for free reception thereof on the first and second associated spaced apart closure rings of the loose leaf ring binder;

wherein at least said upper elongated flap has a first cut line extending between the first attachment hole at said first end and said first transverse edge separating opposed lands thereof; and wherein at least said upper elongated flap has a second cut line extending between the second attachment hole at said first end and said second transverse edge separating opposed lands thereof;

whereby relative flexure of said opposed lands adjacent said first and second transverse edges causes enlargement, respectively, of the openings created by the first and second cut lines for selective removal of said first end from the closure rings of the ring binder.

4. A stationery appliance as set forth in claim 1 including:

an index tab integral with said bight portion and extending away therefrom in a direction away from said first end.

5. A stationery appliance as set forth in claim 2 including:

a reinforcement strip extending along each of said first and second ends, encompassing the attachment holes therein, and being bonded thereto.

6. A stationery appliance as set forth in claim 2 wherein each of said upper and lower elongated flaps has an outer surface and an inner surface; and including:

a reinforcement strip extending along each of said first and second ends, folded along said first longitudinal edge so as to overlie said upper and lower surfaces and encompass the attachment holes therein.

7. A stationery appliance as set forth in claim 1 including:

an elongated reinforcement band having opposed surfaces extending along each of said first and second ends and coextensive with the attachment holes therein, said first ends of said elongated strip being folded to overlie said opposed surfaces of said reinforcement band and being bonded thereto, said second ends of said elongated strip being folded to overlie said opposed surfaces of said reinforcement band and being bonded thereto.

8. A stationery appliance for use with a loose leaf ring binder having at least two closure rings capable of holding punched sheets in an organized manner, said stationery appliance comprising:

grouping means encircling a plurality of the sheets to define an integral group thereof and maintain the integral group segregated from all of the other sheets held by the closure rings of the ring binder, said grouping means being selectively releasable to permit inspection of individual sheets of the integral group or removal of individual sheets from the ring binder, said grouping means including:

an upper elongated flap of flexible sheet material extending between inner and outer ends;

a lower elongated flap of flexible sheet material extending between inner and outer ends, said lower elongated flap being generally coextensive with said upper elongated flap, said upper and lower elongated flaps being adapted to receive therebetween the integral group of sheets, said upper elongated flap being generally contiguous with an uppermost sheet of the integral group thereof and said lower elongated flap being generally contiguous with a lowermost sheet of the integral group thereof;

said upper and lower elongated flaps being joined along said outer ends thereof;

said upper and lower elongated flaps each having an attachment hole adjacent said inner end thereof for being freely received on the closure rings of the ring binder, said inner end of said upper elongated flap being removable from the closure ring allowing said upper elongated flap to be lifted away from the uppermost sheet of the integral group of sheets to thereby yield free access to the individual sheets of the integral group thereof.

9. A stationery appliance as set forth in claim 8 wherein each of said elongated flaps has first and second spaced apart generally parallel longitudinal edges and first and second spaced apart generally parallel transverse edges extending between said longitudinal edges; and wherein at least said upper elongated flap has a cut line extending between the attachment hole at said first end and said first transverse edge thereby separating opposed lands thereof and resulting in an opening therebetween enabling relative flexure of said opposed lands to enlarge the opening created by the cut line for selective removal of said first end from the closure ring of the ring binder and attachment thereto.

10. A stationery appliance as set forth in claim 8 wherein each of said elongated flaps has first and second spaced apart generally parallel longitudinal edges and first and second spaced apart generally parallel transverse edges extending between said longitudinal edges; and wherein said upper elongated flap has first and second spaced apart attachment holes adjacent said first end for free reception thereof on first and second associated spaced apart closure rings of the loose leaf ring binder;

wherein said lower elongated flap has first and second spaced apart attachment holes adjacent said second end for free reception thereof on the first and second associated spaced apart closure rings of the loose leaf ring binder;

wherein at least said upper elongated flap has a first cut line extending between the first attachment hole at said first end and said first transverse edge separating opposed lands thereof; and wherein at least said upper elongated flap has a second cut line extending between the second attachment hole at said first end and said second transverse edge separating opposed lands thereof;

whereby relative flexure of said opposed lands adjacent said first and second transverse edges causes enlargement, respectively, of the openings created by the first and second cut lines for selective removal of said first end from the closure rings of the ring binder and attachment thereto.

11. A stationery appliance as set forth in claim 8 including:

an index tab integral with said outer end and extending away therefrom in a direction away from said inner end.

12. A stationery appliance as set forth in claim 8 including:

a reinforcement strip extending along each of said inner end of said upper and lower elongated flap, encompassing the attachment holes therein, and being bonded thereto.

13. A stationery appliance as set forth in claim 9 wherein each of said upper and lower elongated flaps has an outer surface and an inner surface; and including:

a reinforcement strip extending along said inner end of said upper elongated flap and of said lower elongated flap, said reinforcement strip being folded along said longitudinal edges at said inner ends thereof so as to overlie said upper and lower surfaces, encompass the attachment holes therein, and be bonded thereto.

14. A stationery appliance as set forth in claim 9 including:

an elongated reinforcement band having opposed surfaces extending along said longitudinal edges at said inner ends of said upper and lower elongated flaps and coextensive with the attachment holes therein, said inner end of said upper elongated flap being folded to overlie said opposed surfaces of said reinforcement band and being bonded thereto, said inner end of said elongated strip being folded to overlie said opposed surfaces of said reinforcement band and being bonded thereto.

15. A stationery appliance as set forth in claim 2 wherein each of said upper and lower elongated flaps has an outer surface and an inner surface; and including:

gripper means at said bight portion including:

a semi-rigid band of sheet material folded along a central edge so as to overlie said outer surfaces of said upper and lower elongated flaps at said bight portion and extending to an upper terminal transverse edge and to a lower terminal transverse edge spaced proximately from said bight portion and distantly from said longitudinal edges of said upper and lower elongated flaps, respectively, said inner surfaces of said upper and lower flaps being bonded together at a region extending from said central edge to locations intermediate said central edge and said upper and lower terminal transverse edges to thereby define a pocket extending generally intermediate said bonded region and a line generally coterminous with said upper and lower terminal transverse edges for the embracing reception thereat of a plurality of edges of the integral group of sheets by the inner surfaces of the upper and lower flaps, said upper and lower elongated flaps having a grip coating on their inner surfaces for adhering engagement with adjacent sheets of the integral group of sheets.

* * * * *